United States Patent [19]

Rotondo

[11] Patent Number: 4,491,098

[45] **Date of Patent: * Jan. 1, 1985**

[54] DEVICE FOR ALTERING CAM PROFILE

[76] Inventor: Richard D. Rotondo, 2838 Arthur St., NE., Minneapolis, Minn. 55418

[ * ] Notice: The portion of the term of this patent subsequent to Jul. 12, 2000 has been disclaimed.

[21] Appl. No.: 427,980

[22] Filed: Sep. 29, 1982

Related U.S. Application Data

[63] Continuation-in-part of Ser. No. 205,728, Nov. 10, 1980, Pat. No. 4,392,461.

[51] Int. Cl.[3] ..... F01L 1/34; F01L 1/24

[52] U.S. Cl. ..... 123/90.16; 123/90.46; 123/90.58

[58] Field of Search ..... 123/90.16, 90.39, 90.46, 123/90.47, 90.55, 90.58

[56] References Cited

U.S. PATENT DOCUMENTS

| | | | |
|---|---|---|---|
| 2,053,743 | 9/1936 | Russell | 123/90.46 |
| 2,404,241 | 7/1946 | MacMillan | 123/90.46 |
| 2,434,386 | 1/1948 | Bradshaw | 123/90.46 |
| 2,764,141 | 9/1956 | Schoonover | 123/90.47 |
| 2,827,028 | 3/1958 | Dadd | 123/90.47 |
| 2,833,257 | 5/1958 | Lengnick | 123/90.46 |
| 3,024,775 | 3/1962 | Wuest | 123/90.33 |
| 3,678,906 | 7/1972 | Repko et al. | 123/90.47 |
| 3,880,127 | 4/1975 | Abell, Jr. | 123/90.35 |
| 4,020,806 | 5/1977 | Aomaya et al. | 123/90.55 |
| 4,104,996 | 8/1978 | Hosono et al. | 123/90.43 |
| 4,192,263 | 3/1980 | Kitagawa et al. | 123/90.39 |

FOREIGN PATENT DOCUMENTS

| | | | |
|---|---|---|---|
| 165231 | 6/1921 | United Kingdom | 123/90.46 |

OTHER PUBLICATIONS

Angrist, S. W., "Fluid Control Devices", *Scientific American,* vol. 211, No. 6, (Dec. 1964), pp. 80–88.

*Primary Examiner*—Ira S. Lazarus
*Assistant Examiner*—R. S. Bailey
*Attorney, Agent, or Firm*—Burd, Bartz & Gutenkauf

[57] ABSTRACT

A rocker arm adapter for use in the timing mechanism of an internal combustion engine is disclosed. The adapter is a method for altering the cam profile of the exhaust valve of the engine with respect to the intake valve. It includes a fluidic delay device mounted in either the first end or the second end of the rocker arm. The delay device includes a piston which is allowed to move various distances in a cavity formed in the rocker arm, the distance being directly related to the speed of movement of a push rod member. As the speed of the engine, and the speed of movement of the push rod, increases, the piston will be allowed to move a greater distance into the cavity so that the delay in actuation of the rocker arm by the push rod is increased.

28 Claims, 7 Drawing Figures

DEVICE FOR ALTERING CAM PROFILE

CROSS REFERENCE TO RELATED APPLICATION

This application is a continuation-in-part of U.S. application Ser. No. 205,728, filed Nov. 10, 1980, now U.S. Pat. No. 4,392,461.

TECHNICAL FIELD

The invention refers to internal combustion engines having components which control cam action for operating the valves to effectuate more efficient and economic engine operation.

BACKGROUND OF PRIOR ART

Because of a number of factors, not the least important of which is the rising cost of gasoline, the development of automobiles which have engine components to accomplish efficient and economic use of gasoline fuel has become an urgent project of the world's technological community. Nor is there any indication that fuel costs will decline in the foreseeable future so as to reduce the importance of the development of inventions which effectuate more efficient combustion of the air/fuel mixture fed into the engine cylinders.

In the four-stroke gasoline engine powering many automobiles, operation of the inlet and exhaust valves for each cylinder is coordinated with the position of the piston within the cylinder. During the first stroke of the piston, the induction stroke, the inlet valve is open so that an air/fuel mixture fed to the cylinder inlet from the carburetor via an intake manifold can be admitted into the cylinder. During the compression stroke the piston moves upwardly within the cylinder to compress the air/fuel mixture. During this stroke, therefore, both the inlet and exhaust valves must be closed.

The third stroke, or power stroke, involves downward movement of the piston in response to combustion of the air/fuel mixture when it is ignited by a spark provided by a spark plug. Again, both valves must be closed in order to effectuate maximum downward force upon the piston. If one or both of the valves were open, the gases, while expanding, would, at least partially, be allowed to be vented through the open valve.

The exhaust stroke begins as the piston again begins upward movement within the cylinder. During this stroke the exhaust valve must be open so that the by-products of combustion can be vented therethrough. After venting of these by-products occurs, the exhaust valve closes and the inlet valve again opens in order to begin a new cycle.

Normally, the valves are biased to a closed position, and they are open according to a predetermined timing schedule. This timing is coordinated by a cam-push rod-rocker arm arrangement provided for each valve. As the cam rotates, it translates its rotary motion into axial motion of the push rod. The push rod, in turn, causes pivoting of the rocker arm to open the particular valve involved. Rotation of the cam is geared to rotation of a crank shaft common to all cylinders in the engine. The crank shaft is made to rotate by use of a connecting rod extending from the piston in each cylinder. Consequently, the up and down movement of the piston within the cylinder can be translated into appropriately timed opening and closing of the respective inlet and exhaust valves of the particular cylinder.

In some engines, the volume of the air/fuel mixture introduced into the cylinders is dependent upon the speed of the engine and the particular mode of operation thereof. Specifically, if the engine is in a period of acceleration, the volume of fuel being admitted to the cylinder will likely be greater than during a period of constant speed cruising, deceleration, or idling. If the cam profile has not been varied, the valves will open in accordance with the same timing schedule as it would during other modes of operation of the engine, and complete and efficient combustion of all of the air/fuel mixture will not occur.

Technology has provided devices to cure this defect to some degree. Different methods have been invented to alter the cam profile so that the exhaust valve stays closed longer and the intake valve opens later in order to effect more complete burning of the air and fuel. These devices are mechanical means which delay the opening of the exhaust valve and opening of the intake valve a fixed amount regardless of the speed and operational mode of the engine. Consequently, in certain modes of operation, complete and efficient combustion may have already occurred, and the valves have not yet opened. This gives rise to less efficient operation of the engine.

Although valve opening and closing occurs at a high rate of speed, maximum engine efficiency is frequently not attained because of comparatively sluggish valve actuation. A high valve lift rate or speed of valve opening can improve performance significantly over that obtained where valve lift rate is low.

It is to these problems to which the invention of the present application is directed. It provides a structure which effectuates an alteration in the operation of the intake and/or exhaust valves which is directly proportional to the engine speed. The alteration of valve operation, such as a delay in the opening of the intake valve, is directly proportional to the quantity of gasoline introduced into the cylinder. It, therefore, maximizes the efficiency of combustion regardless of the speed at which the engine operates and the richness of the air/fuel mixture.

SUMMARY OF THE INVENTION

The present invention is a device operable to alter the operation of a cam during use of the cam to transmit motion and force from the cam to a cam follower. The device has body means having a cavity accommodating manifold means and defining a first chamber means and a second chamber means for accommodating a fluid, such as a liquid. The second chamber means is separated into a plurality of chambers having different volumes. Each chamber has means for moving fluid out of the chamber. The manifold means has inflow passage means and diversion passage means obliquely intersecting the inflow passage means and open to the second chamber. The manifold means also has a plurality of outflow channels open to the inflow passage means and the plurality of each of the chambers. The piston means is movably mounted on the body means closing the second chamber means. A fluid fills both chamber means and passages and channels between the chamber means. In use, when movement from the cam is transferred to the piston means, the fluid in the second chamber means is forced through the inflow passage means and diversion passage means. The fluid in the diversion passage means shunts fluid in the inflow passage means into one or more outflow channels in accordance with the amount of force applied to the piston means. This provides additional volume or storage space for the fluid. The result is that the effective length of the device is changed in accordance with the force applied to the piston means. The greater the force, the greater the change in the length of the device. When the device is used with rotating cams, the speed of rotation of the cams is a function of the force transferred from the cams to the cam followers. Thus, the device changes the cam profile of a rotating cam.

The fluid is preferably a liquid, such as oil. Special liquids that have the property of varying viscosity in response to the amount of pressure applied to the liquid can be used in the device. When this type of liquid is used in the device, the operation of the cam is altered during periods when the cam speed is increasing and decreasing. The operation of the cam is not substantially altered when it is operated at a constant speed.

In one embodiment, the device is an adapter for use with the rocker arm of valves of an internal combustion engine of the type typically used in an automobile. It has as an objective the altering of the cam profile of one or both of the intake and exhaust valves of the engine. The adapter alters or changes the cam profile varying amounts depending on the speed of the engine. A conventional Otto cycle internal combustion engine has a rocker arm mounted in a see-saw manner for pivoting movement between first and second positions. The rocker arm has a first end engaged by a push rod adapted for longitudinal movement in response to cam actuation, and a second end engaging a valve stem of the exhaust valve of the engine. The rocker arm, as it moves from the first to its second position, opens the valve by overcoming a spring bias urging the valve to its closed position. The device includes a piston which is mounted for movement into and out of a cavity formed in a body associated with either the first or second end of the rocker arm. The portion of the rocker arm which comprises or engages the piston cooperated with either the push rod or the valve stem, depending upon the end of the rocker arm in which the cavity is formed. The device further includes means for precluding movement of the piston beyond certain defined positions which are dependent upon the speed with which the push rod longitudinally moves. When the cavity is formed in a body associated with the first end of the rocker arm, that is, the end which is engaged by the push rod, movement of the push rod toward the rocker arm will, for a time, be absorbed as the piston moves into the cavity a predetermined distance. After further movement of the piston is prohibited, the longitudinal movement of the push rod will be translated into pivoting movement of the rocker arm. This pivoting movement will, in turn, effect opening of the valve of the cylinder. In an embodiment in which the cavity is formed in a body associated with the second end of the rocker arm, the rocker arm will respond immediately to the longitudinal movement of the push rod toward the rocker arm. Opening of the valve will be delayed since the piston engagement with the end of the valve stem is moved into the cavity by the resistance of the bias urging the valve closed. When movement of the piston becomes precluded, the valve will respond to the pivoting movement of the rocker arm and open the valve.

In a preferred embodiment, the distance which the piston will be allowed to move into the cavity in response to the speed of the push rod includes a manifold member mounted on the body in the cavity. The manifold member is fixedly mounted within the cavity to define an exterior chamber between one end of the member and the piston, and a plurality of variable volume interior chambers on the opposite side of the member. Each interior chamber has a maximum volume to which it can expand, and these maximums vary from chamber to chamber.

In this embodiment, the exterior chamber is filled with a fluid. Fluid communication is provided from the exterior chamber to each of the interior chambers by a passageway network provided through the manifold member. An inflow passageway communicates with the exterior chamber and divides into a plurality of outflow channels, each of these channels entering into a different one of the interior chambers.

Means are provided for channeling the bulk of fluid flow from the exterior chamber through the inflow passageway in response to piston movement, into a different one of the outflow channels depending upon the speed of the longitudinal movement of the push rod. When the speed of the push rod is great, fluid flow through the inflow passageway is directed to the outflow channel entering into that interior chamber having the greatest maximum volume to which any interior chamber can expand. As the longitudinal speed of movement of the push rod decreases, the bulk of fluid flow through the inflow passageway is redirected into an outflow channel which enters into an interior chamber having a maximum expansible volume smaller than that chamber into which the fluid flow empties at the higher rate of speed of the push rod. The bulk of flow through the inflow passageway is channeled into various other outflow channels entering into inner chambers having variable volumes expansible to maximum volumes progressively smaller as the speed of the push rod decreases even further.

This channeling of flow can be accomplished by providing a diversion passageway communicating at one end with the exterior chamber and in which fluid flow is induced by movement of the piston. The diversion passageway intersects at its opposite end with the inflow passageway, and this intersection is oblique with respect to a directional axis along which the inflow passageway is oriented. Thus, as the speed of fluid flow through the diversion passageway, which speed is directly proportional to the speed of movement of the push rod, increases, flow through the diversion passageway will effect a greater deflection of the fluid flow through the inflow passageway. The outflow channel which flows into the interior chamber having the greatest maximum volume can, therefore, be disposed with respect to the directional axis along which the inflow passageway is oriented so that there is a degree of angular variation therebetween commensurate with the amount of fluid flow deflection which occurs at a high speed of longitudinal movement of the push rod. At low speeds of push rod movement, flow through the inflow passageway may be diverted only slightly, or even not at all. The outflow channel entering into the interior chamber having the smallest maximum volume can, therefore, be oriented substantially along the directional axis of the inflow passageway. Other outflow channels can have a measure of angular variation from the directional axis of a measure somewhere between that of the two channels heretofore discussed.

When the device of the invention is used with a cam, push rod and rocker arm associated with an internal combustion exhaust valve, there is a time delay in the opening of the exhaust valve. The amount of time delay depends on the speed of operation of the engine. The greater the speed of the engine, the greater the delay in opening the exhaust valve up to a predetermined time delay. The delay in opening the exhaust valve causes a retention of some of the burned gases in the combustion chamber of the engine. These gases are stratified with the air/fuel mixture introduced into the combustion chamber on the intake stroke. A fuel saving is achieved since a smaller amount of fuel will produce a mixture rich enough to ignite when the spark plug fires.

When the device of the invention is used with an intake valve, the cam profile limits the amount of air/fuel mixture introduced into the combustion chamber by delaying the opening and advancing the closing time of the intake valve. The fluidic circuit of the device is programmed along the entire RPM range of the engine to provide a valve opening delay responsive to engine speed.

The invention of this application is a fluidic controlled device which alters the cam profile varying amounts depending upon the speed of movement of the push rod. The device can be adapted to be located in the motion transmitting means between the cam and valve stem. The device achieves automatic adjustment of valve clearance and operation. Specific advantages of the invention will become apparent with reference to the accompanying drawings, detailed description of the invention, and claims.

DESCRIPTION OF THE PREFERRED EMBODIMENT

Figure 1:
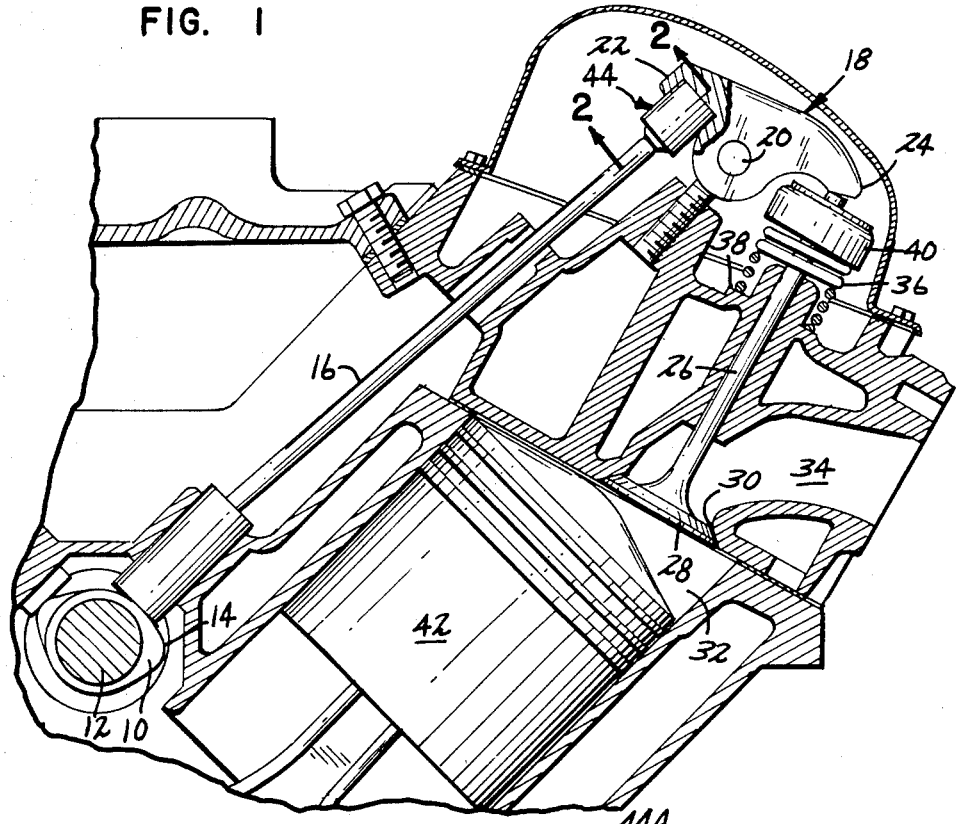
FIG. 1 is a fragmentary transverse sectional view of an internal combustion engine equipped with the fluidic delay device of the invention.

Referring now to the drawings, wherein like reference numerals denote like elements throughout the several views, FIG. 1 illustrates a portion of the timing mechanism for a cylinder of an internal combustion engine. The timing assembly includes a cam 10 mounted on a cam shaft 12 for rotation therewith. Cam 10 has an eccentric peripheral surface 14 which is engaged by one end of a push rod 16. As cam shaft 12 rotates and push rod 16 rides up eccentric surface 14 of cam 10, the rotational motion of cam 10 is translated into longitudinal motion of push rod 16.

A rocker arm 18 is pivotally mounted proximate the opposite end of push rod 16. In FIG. 1, the rocker arm 18 is shown as being pivotally mounted for movement about a pivot 20 intermediate opposite first and second ends 22, 24 of rocker arm 18. Rocker arm 18 pivots on pivot 20 in a see-saw fashion.

A first end 22 of rocker arm 18 is in operative engagement with a fluidic device 44 of the invention. Device 44 engages the second end of push rod 16. As push rod 16 moves longitudinally toward rocker arm 18, it will cause rocker arm 18 to move from a first position, which is the most counterclockwise position that the rocker arm 18 can assume, to a second position, which is the most clockwise position that rocker arm 18 can assume.

Second end 24 of rocker arm 18 engages the outer end of a valve stem 26. Valve stem 26 extends from a main valve portion or head 28 which occludes an exhaust port 30 providing egress from combustion chamber 32 to an exhaust passageway 34. The valve 28 is normally biased toward a closed position with coil spring 36. Spring 36 engages a shoulder 38 on the engine block and a collar 40 attached to valve stem 26.

FIG. 1 shows the valve head 28 in a closed position and rocker arm 18 in its first position. As cam 10 rotates in a direction clockwise as viewed in FIG. 1, push rod 16 will move longitudinally upward and to the right and cause rocker arm 18 to rotate in a clockwise direction to its second position. This will, in turn, cause valve head 28 to be urged downwardly to its open position, overcoming the bias of spring 36. This particular functioning will occur during the exhaust stroke of piston 42 mounted for movement within the cylinder in the block.

It is known that, during the operation of an automobile internal combustion engine, a substantial quantity of the air/fuel mixture introduced into combustion chamber 32 is not effectively and efficiently burned. This problem can be remedied by delaying the opening of the exhaust valve so that the mixture can be combusted within the combustion chamber for a longer period of time. Various devices have sought to achieve a solution to the problem, but, in each case, the valve has been held closed only for a set period of time. Since the amount of combustible air/fuel mixture introduced into the combustion chamber varies depending upon the mode of operation of the engine, the amount of delay in opening the valve should also vary in order to obtain most efficient operation.

A fluidic delay device, generally indicated at 44, made in accordance with the present invention effectuates this variable delay. Such a device is shown, in FIG. 1, mounted in the first end 22 of rocker arm 18. It will be understood, however, by those of skill in the art, that such a fluidic delay device 44 could just as appropriately be formed in the second end 24 of rocker arm 18. The fluidic device can be located in push rod 16 or between the lower end of rod 16 and cam 10.

Device 44 includes a piston 46 which is disposed within a cavity formed in a cylindrical body 45. Body 45 can be part of one of the ends of the rocker arm 18. Piston 46 includes a push rod engagement face 48 engaged by the upper end of push rod 16. In embodiments wherein the device is mounted on or formed in the second end 24 of rocker arm 18, face 48 of piston 46 would engage the end of valve stem 26.

Figure 2:
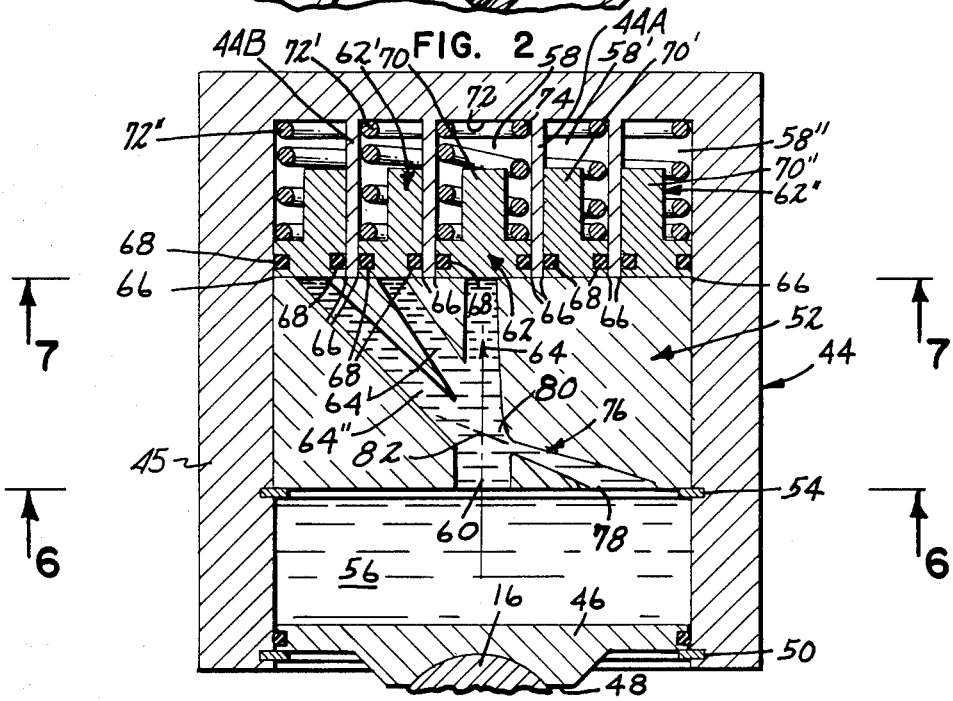
FIG. 2 is an enlarged sectional view taken substantially along the line 2—2 of FIG. 1 showing the piston withdrawn substantially to the entrance to the fluidic delay device cavity.

Referring now to FIG. 2, the interior of the cavity formed in the body 45 is illustrated. Piston 46 is disposed for movement into and out of the cavity. Positive means, such as a retaining ring 50, mounted on the inside of body 45, preclude complete withdrawal of piston 46 from the cavity.

Mounted at a fixed location generally centrally within the cavity is a manifold member 52. Member 52 is maintained in a fixed axial position within the cavity by means of a retaining ring 54 mounted on the inside of body 45.

Figure 7:
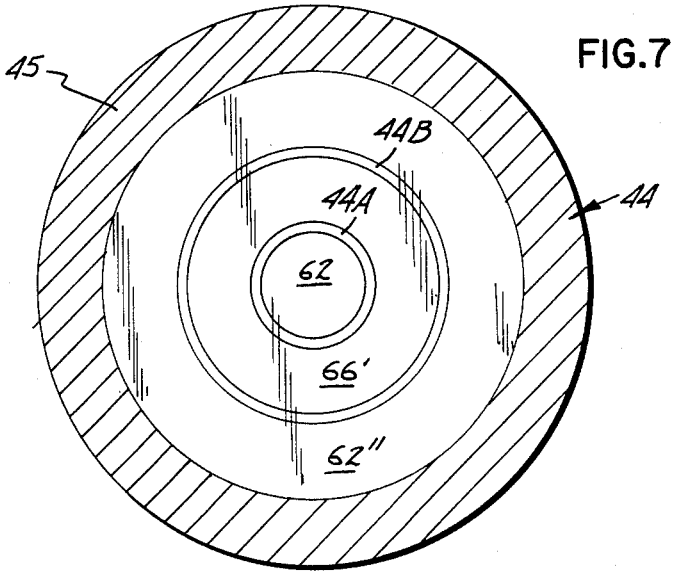
FIG. 7 is a sectional view taken along the line 7—7 of FIG. 2.

An exterior or first chamber 56 is defined between manifold member 52 and piston 46. An interior or second chamber is defined between the opposite end of member 52 and the inner end of the cavity. This interior chamber is, in turn, subdivided into a plurality of smaller interior chambers 58, 58', 58". FIGS. 2 and 7 show a cavity which is circularly cylindrical in cross section. The interior chamber is separated into three chambers 58, 58', and 58". The first chamber 58 comprises a small circularly cylindrical chamber centrally positioned within the cavity. The second chamber 58' is an annular chamber surrounding the first chamber 58. The third chamber 58" is an annular chamber concentrically disposed about the second annular chamber 58'. Each interior chamber 58, 58', and 58" has a similar axial length, the volumes of these chambers increase in a radially outward direction. Each successive radially outward chamber 58, 58', 58" has a larger cross-sectional area than does the chamber immediately radially inward therefrom.

The exterior chamber 56 is filled with a fluid, and fluid communication is provided between that chamber 56 and the interior chambers 58, 58', 58" through the manifold member 52. An inflow passageway 60 provides egress for the fluid from the exterior chamber 56. The inflow passageway 60 thereafter divides into a plurality of outflow channels 64, 64', 64". The number of outflow channels 64, 64', 64" are the same as the number of interior chambers 58, 58', 58".

Each interior chamber 58, 58', 58" can include means for normally maintaining said chambers empty of fluid. In one embodiment, these means can take the form of pistons 62, 62', 62" mounted within each chamber 58, 58', and 58", respectively. These pistons are biased to occlude a second end of outflow channels 64, 64', 64" which empties into the respective interior chambers 58, 58', 58". Radial edges 66 of pistons 62, 62', 62" are sealed by use of O-rings 68 so that fluid caused to be passed through manifold member 52 will exert force on the face of pistons 62, 62', 62" rather than leaking around the edges 66. Similarly, piston 46 disposed in the exterior chamber 56 is sealed with an O-ring to preclude leakage of the fluid out of the cavity.

Fluid delay device 44 includes means for precluding movement of piston 46 operably disposed within exterior chamber 56 beyond various positions within this chamber. Movement of piston 46 can be precluded by preventing the volumetric expansion of the various interior chambers 58, 58', 58" beyond a certain volume as fluid in exterior chamber 56 is forced through the manifold member 52 and into the various interior chambers 58, 58', 58". This is accomplished by providing a stop portion 70, 70', 70" on each piston disposed within the interior chambers so that each interior chamber cannot expand beyond a desired capacity. As each piston 62, 62', 62" is moved by the inflow of fluid through the outflow channels 64, 64', 64" and the volume of a chamber expands, the stop portion 70, 70', 70" attached to each piston engages base 72 of body 45 to preclude further expansion.

It is pointed out that the bias of spring 36 urging valve 28 to its closed position must exceed the bias of an individual spring 74, 74', 74" urging each piston 62, 62', 62" operatively disposed within an interior chamber to a position adjacent manifold member 52. If the reverse were true, the motion of push rod 16 would not be absorbed by the fluidic delay device 44, and the valve movement would directly correspond to the movement of push rod 16. Since, however, the relative biases are as stated, the device will function to delay opening of the valve even as push rod 16 moves longitudinally.

The aggregate biasing effect of two of the springs 74, 74', 74" within interior chambers 58, 58', 58" exceeds the biasing effect of spring 36 urging the valve to its closed position. This is the relative relationship so that, as one of pistons 62, 62', 62" within an interior chamber 58, 58', 58" moves to allow expansion of the chamber to its maximum, spring 36 biasing valve 28 to its closed position will not be capable of resisting the force tending to urge rocker arm 18 to its second position since the fluid within delay device 44 would then be working to overcome the bias of the second spring in addition to the first. Consequently, as movement of push rod 16 causes piston 46 disposed in exterior chamber 56 to force fluid into the inflow passageway 60 and into primarily one of the interior chambers 58, 58', 58" by a method to be described hereinafter, the force biasing piston 62, 62', 62" in that particular chamber to a position adjacent manifold member 52 will be overcome and piston 62, 62', 62" will move. As the interior chamber 58, 58', 58" expands to its maximum volume, further movement of that particular piston 62, 62', 62" will be precluded and fluid flow will tend to be diverted into another one of the outflow channels 64, 64', or 64". Since the fluid flow would then be directed to overcoming the bias of two of the interior chamber springs 74, 74', 74", the least resistance would be encountered at the spring 36 biasing the valve 28 to its closed position, and further movement of piston 46 in the exterior chamber 56 would be precluded. Pivoting motion would then be imparted to rocker arm 18, and the valve 28 would be opened.

Figure 6:
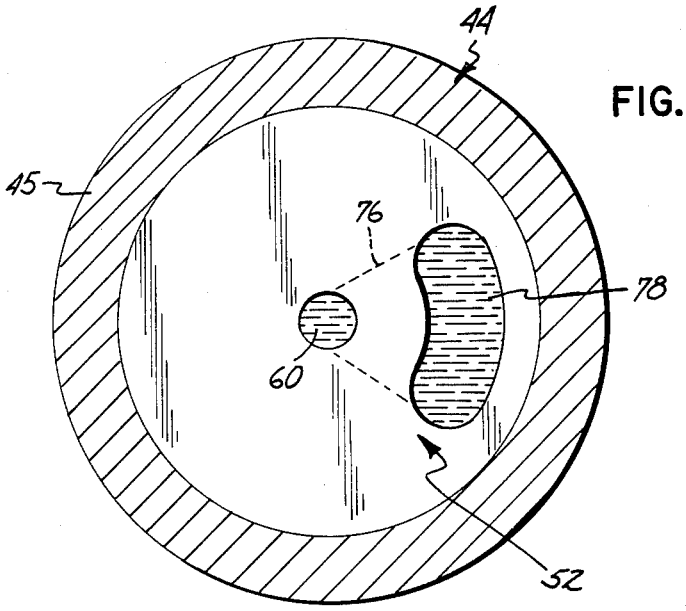
FIG. 6 is a sectional view taken along the line 6—6 of FIG. 2.

Manifold member 52 has a diversion passageway 76 operable to automatically direct fluid flowing from passageway 60 into one or more outflow channels 64, 64', and 64" in response to the speed of movement of push rod 16. As shown in FIG. 6, diversion passageway 76 has an elongated arcuate inlet opening 78 in the end of manifold member 52 facing piston 46. The inlet opening 78 is offset from central passageway 60. Passageway 76 converges and extends radially inwardly to an outlet opening 80 in communication with a side of passageway 60. The longitudinal axis of passageway 76 intersects the center of the opening or mouth of outflow channel 64". Passageway 76 obliquely intersects main inflow passageway 60. Fluid is forced from chamber 56 when movement is imparted to piston 46 by push rod 16. With this structuring, fluid flow through both of passageways 60, 76 will increase directly as the speed of longitudinal movement of push rod 16 increases.

The inflow passageway 60 is oriented along a directional axis 82. As the flow of fluid through the inflow passageway 60 is struck by the fluid flow through deflection passageway 76, deflection of the main fluid flow path will occur toward channels 64' and 64".

Figure 3:
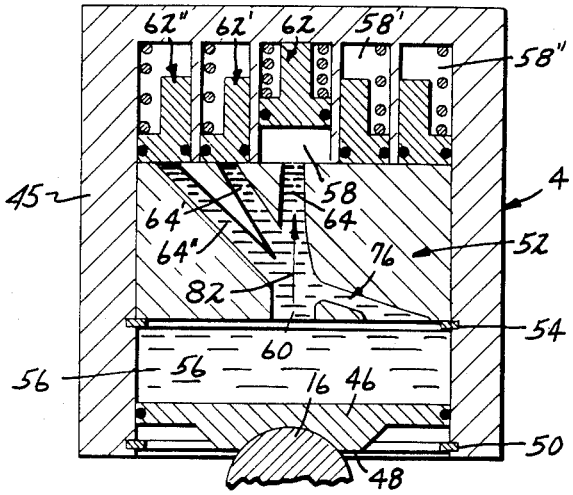
FIG. 3 is a sectional view similar to FIG. 2 smaller in scale wherein fluid flow through the inflow passageway is substantially undiverted by the obliquely intersecting fluid flow through the diversion passageway and has entered into an interior chamber having a relatively small, maximum expansible volume.
Figure 4:
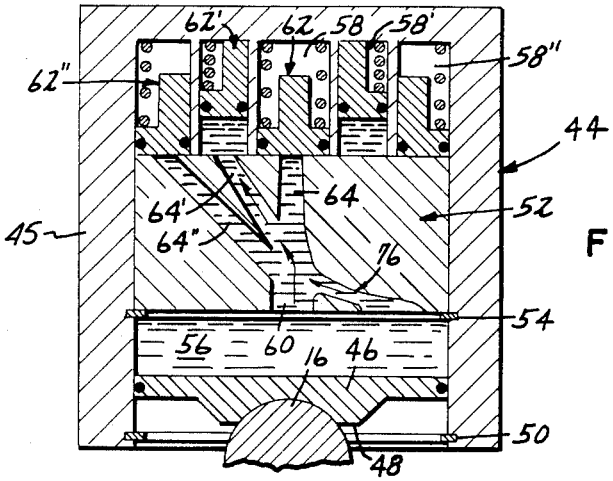
FIG. 4 is a sectional view similar to FIG. 3 where the bulk of fluid flow through the inflow passageway is somewhat diverted into an interior chamber having a maximum expansible volume somewhat greater than the interior chamber into which flow enters in FIG. 3.
Figure 5:
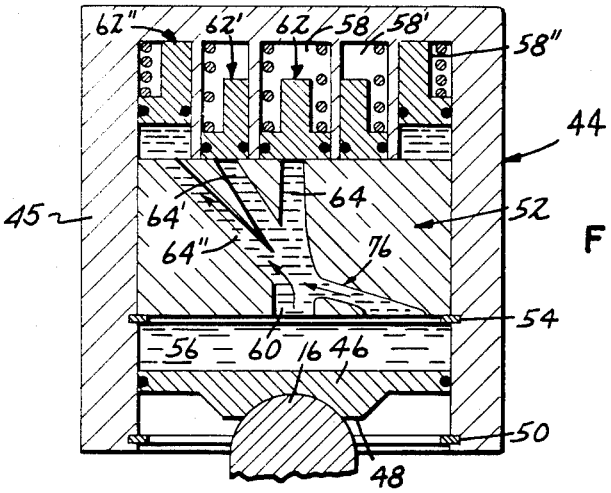
FIG. 5 is a sectional view similar to FIG. 3 in which the bulk of fluid flow through the inflow passageway is diverted to enter an interior chamber having the greatest maximum expansible volume.

Referring now to FIGS. 3, 4, and 5, when the speed of push rod 16 is slow, fluid flow rates through both inflow passageway 60 and diversion passageway 76 are also low, and the main flow will continue substantially undivided. Outflow channels 64 are oriented substantially along the directional axis 82 of inflow passageway 60.

As the speed of the push rod 16 increases, the rates of flow through both passageways 60, 76 will also increase, and the force obliquely applied to the main fluid flow by the fluid flow through diversion passageway 76 will cause some angular diversion of the fluid flow. Outflow channel 64' channels the fluid flow to annular interior chamber 58', as shown by arrows in FIG. 4.

When the speed of push rod 16 increases even further, so will the rates of fluid flow through inflow passageway 60 and diversion passageway 76. The diversion fluid flow will cause an even greater oblique force to be applied to the main fluid flow, and the greatest angular diversion of the main flow will occur. A third outflow channel 64" is provided to conduct the fluid flow to interior annular chamber 58", as shown by arrows in FIG. 5.

In FIG. 3, wherein the speed of the push rod 16 is lowest, fluid flow is channeled to the interior chamber 58 having the smallest of the maximum volumes to which any of chambers 58, 58', 58" can expand. As the speed of push rod 16 and rates of flow through the passageways 60, 76 increases, flow will be channeled to interior chamber 58' having a somewhat larger maximum expansible volume so that pivoting of rocker arm 18 will be delayed somewhat longer. When the speed of push rod 16 and the fluid flow rates through the passageways 60, 76 are greatest, fluid flow deflection will be greatest, and the flow will be channeled to interior chamber 58" having the greatest maximum expansible volume. Consequently, acutation of pivoting movement of rocker arm 18 will be delayed the longest in this instance. FIGS. 3, 4, and 5 illustrate the maximum movement of piston 46 disposed in the exterior chamber 56, axially with respect to the cavity, in these three discussed instances. It is observed that, as the speed of push rod 16 and fluid flow rate through passageways 60, 76 increases, piston 46 will be allowed to move a greater axial distance into the exterior chamber 56.

In order to increase the response rate once the desired delay has been accomplished, a relatively incompressible fluid can be used. The delay will be effected by the diversion of fluid flow into interior chambers 58, 58', 58" having different maximum expansible volumes rather than by compression of the fluid. Another factor which bears on the selection of the fluid to be used is the ability to accomplish desired deflection of the main fluid flow by the diversion flow.

The fluid contained within the cavity of body 45 by piston 46 can be a pressure sensitive fluid which has a viscosity that increases when subjected to pressure. In other words, the viscosity of the fluid increases in proportion to the compression force or pressure applied to the fluid. An example of this type of fluid is SONOTRAC liquid made by Monsanto Chemical Company, of St. Louis, Mo. The speed of rotation of cam 10 determines the force applied to fluidic device 44 and the compression force on the fluid contained therein. As the speed of cam 10 increases, the force on the fluid increases and the viscosity of the fluid increases. Increased viscosity of the fluid causes reduced movement of fluid in channels 64, 64', and 64". Thus, the delay device 44 will remain at a substantially fixed length when subjected to high forces associated with high speeds. At slow cam speeds the fluid freely flows through the channels between the first and second chambers of the manifold member providing a time delay operation of the valve. At high cam speeds, the increased viscosity of the fluid retards the flow of fluid through the channels 64, 64', 64" in manifold 52. This reduces the time delay actuation of fluidic device 44. The pressure sensitive fluid senses the change of engine speed and operates to change operating characteristics or cam profile of the cam. At full acceleration, device 44 will simulate a racing cam profle. During steady speed conditions, the fluid will relax and revert to an economy cam profile. A maximum economy cam profile is attained during deceleration of the engine.

As will be apparent to one of skill in the art, the arrangement hereinbefore described has other advantages. In addition to effectuating a desired delay in the opening of valves, it also causes the interior chambers 58, 58', 58" to be emptied of fluid as the push rod withdraws so that the proper delay can be again imposed during subsequent exhaust strokes of the cylinders' piston 42.

Additionally, so structuring the fluidic delay device 44 will increase the valve lift rate so that an exhaust valve will open sharply, allow the combustion products to be exhausted, and close again sharply prior to allowing intake of more air/fuel mixture during the next stroke of the cylinder. This is so both because of the bias of the springs 74, 74', 74" within the interior chambers 58, 58', 58" and because of some measure of compressibility in the fluid.

Numerous characteristics and advantages of the invention have been set forth in this detailed description. It will be understood, of course, that this disclosure is only illustrative. Changes may be made in many respects, particularly in matters of shape, size, and arrangement of parts without exceeding the scope of the invention. The invention's scope is defined in the language of the appended claims.

The embodiments of the invention in which an exclusive property or privilege is claimed are defined as follows:

1. A fluidic device comprising: means having a cavity, manifold means located in said cavity to define a plurality of first chambers and a second chamber, means holding the manifold means in a fixed position on the means having a cavity, said manifold means having inflow passage means, and diversion passage means obliquely intersecting the inflow passage means, said inflow passage means and diversion passage means communicating with said second chamber, and a plurality of outflow channels open to the inflow passage means and said plurality of first chambers, a fluid filling said first and second chambers, inflow passage means, diversion passage means, and outflow channels, and piston means mounted for sliding movement in the second chamber whereby when force is applied to said piston means fluid flows through the inflow passage means and is deflected by fluid flowing from the diversion passage means to selected outflow channels in proportion to the amount of force applied to the piston means.

2. The device of claim 1 including: means for emptying said plurality of first chambers of said fluid.

3. The device of claim 2 wherein: said means for emptying said plurality of first chambers including a piston located in each of said first chambers, each piston being movable away from said manifold means in response to the flow of fluid into said plurality of first chambers, and means biasing each of said pistons toward said manifold means.

4. The device of claim 3 wherein: one of said pistons is a circular piston and the remaining pistons are annular pistons concentrically located about said circular piston.

5. The device of claim 3 wherein: said fluid is a liquid, said liquid is characterized with a viscosity that increases in proportion to the amount of pressure that is applied to said liquid.

6. The device of claim 3 wherein: said means biasing each of said pistons toward said manifold means comprises compression coil springs.

7. The device of claim 1 wherein: said manifold means has a longitudinal axis, said inflow passage means being centrally located in said manifold means along the longitudinal axis of said manifold means, said diversion passage means obliquely intersecting said inflow passage means adjacent one side of said inflow passage means, said plurality of outflow channels having at least one outflow channel obliquely intersecting the side of the outflow channel means opposite the diversion channel means.

8. The device of claim 7 wherein: said outflow channel includes a first channel axially aligned with the inflow passage means and a plurality of second channels obliquely intersecting the inflow passage means opposite the diversion passage means.

9. The device of claim 8 wherein: said second channels include a pair of channels, said pair of channels having different acute angles with respect to the longitudinal axis of the inflow passage means.

10. The device of claim 1 wherein: said fluid is a liquid.

11. The device of claim 10 wherein: the liquid is characterized with a viscosity that increases in proportion to the amount of pressure applied to said liquid.

12. The device of claim 1 wherein: each of said plurality of first chambers has a different volume into which fluid can flow from a channel open to each of said first chambers.

13. The device of claim 1 wherein: said fluid is relatively incompressible.

14. The device of claim 1 wherein: said diversion passage means has an inlet opening open to said second chamber and an outlet opening open to said inflow passage means, said inlet opening being substantially larger than said outlet opening.

15. An apparatus for atlering the operation of a valve of the valve operating means, said valve being movable between open and closed positions with valve operating means comprising: delaying means associated with the valve operating means for delaying movement of the valve from the closed position to the open position in response to the speed of operation of the valve operating means, said delaying means including means having a cavity, manifold means located in said cavity to define a plurality of first chambers and a second chamber, means holding the manifold means in a fixed position on the means having a cavity, said manifold means having inflow passage means and diversion passage means obliquely intersecting the inflow passage means, said inflow passage means and diversion passage means communicating with said second chamber, and a plurality of outflow channels open to the inflow passage means and the plurality of first chamber, a fluid filling said first chambers, second chamber, inflow passage means, diversion passage means, and outflow channels, and piston means mounted for sliding movement in the second chamber, said piston means being movable in response to operation of the valve operating means to increase the pressure of the fluid causing the fluid to flow in said inflow and diversion passage means and outflow channels.

16. The apparatus of claim 15 including: means for emptying said plurality of chambers of said fluid.

17. The apparatus of claim 16 wherein: said means for emptying said plurality of first chambers includes a piston mounted in each of said plurality of first chambers for movement away from said manifold means in response to the flow of fluid into each of said plurality of first chambers, and means biasing each of said pistons toward said manifold means.

18. The device of claim 17 wherein: one of said pistons is a circular piston and the remaining pistons are annular pistons concentrically located about said circular piston.

19. The device of claim 17 wherein: said fluid is a liquid, said liquid is characterized with a viscosity that increases in proportion to the amount of pressure that is applied to said liquid.

20. The device of claim 17 wherein: said means biasing each of said pistons toward said manifold means comprises compression coil springs.

21. The device of claim 15 wherein: said manifold means having a longitudinal axis, said inflow passage means being centrally located in said manifold means along the longitudinal axis of said manifold means along the longitudinal axis of said manifold means, said diversion passage means obliquely intersecting said inflow passage means adjacent one side of said inflow passage means, said plurality of outflow channels having at least one outflow channel obliquely intersecting the side of the outflow channel means.

22. The device of claim 21 wherein: said channel means includes a first channel axially aligned with the inflow passage means and a plurality of second channels obliquely intersecting the inflow passage means opposite the diversion passage means.

23. The device of claim 22 wherein: said second channels include a pair of channels, said pair of channels having different acute angles with respect to the longitudinal axis of the inflow passage means.

24. The apparatus of claim 15 wherein: said fluid is a liquid.

25. The apparatus of claim 24 wherein: the liquid is characterized with a viscosity that increases in proportion to the amount of pressure applied to said liquid.

26. The apparatus of claim 15 wherein: each of said plurality of first chambers has a different volume into which fluid can flow from a channel open to each of said first chambers.

27. The apparatus of claim 15 wherein: said fluid is relatively incompressible.

28. The device of claim 15 wherein: said diversion passage means has an inlet opening open to said second chamber and an outlet opening open to said inflow passage means, said inlet opening being substantially larger than said outlet opening.

* * * * *